US006781544B2

(12) United States Patent
Saliga et al.

(10) Patent No.: US 6,781,544 B2
(45) Date of Patent: Aug. 24, 2004

(54) DIVERSITY ANTENNA FOR UNII ACCESS POINT

(75) Inventors: Stephen V. Saliga, Akron, OH (US); Fred J. Anderson, Lakeville, OH (US); James A. Mass, North Royalton, OH (US); Timothy A. Frank, Pama, OH (US)

(73) Assignee: Cisco Technology, Inc., San Jose, CA (US)

( * ) Notice: Subject to any disclaimer, the term of this patent is extended or adjusted under 35 U.S.C. 154(b) by 0 days.

(21) Appl. No.: 10/091,164

(22) Filed: Mar. 4, 2002

(65) Prior Publication Data

US 2003/0227414 A1 Dec. 11, 2003

(51) Int. Cl.[7] ..... H01Q 21/00

(52) U.S. Cl. ..... 343/700 MS; 343/725; 343/876

(58) Field of Search ..... 343/700 MS, 725, 343/729, 876, 853, 702; 455/575, 550

(56) References Cited

U.S. PATENT DOCUMENTS 5,594,455 A * 1/1997 Hori et al. ..... 343/700 MS
5,649,306 A * 7/1997 Vannatta et al. ..... 343/702
5,952,922 A * 9/1999 Shober ..... 340/505
6,018,324 A 1/2000 Kitchener
6,031,503 A 2/2000 Preiss, II et al.
6,108,526 A 8/2000 van der Plas
6,127,987 A 10/2000 Maruyama et al.
6,188,913 B1 2/2001 Fukagawa et al.
6,240,301 B1 5/2001 Phillips
6,264,152 B1 7/2001 Bloch et al.

FOREIGN PATENT DOCUMENTS

GB 2317993 4/1998
WO WO 99/60657 11/1999

* cited by examiner

*Primary Examiner*—Hoanganh Le
(74) *Attorney, Agent, or Firm*—Tucker Ellis & West LLP

(57) ABSTRACT

A combination of near omni-directional antennas and internal patch antennas, all built into an access point in accordance with FCC requirements. Typically a printed antenna array is used for the near omni-directional antenna, and the internal patch antenna is a TM10 mode stacked patch antenna. A mechanical detect switch changes antenna types automatically, depending on the rotation state of the antenna system. Alternately, a configuration utility enables a user to select the antenna type for the access point when it is installed in the field. This arrangement gives the UNII access point flexibility to be mounted in various orientations and match the characteristics of the antenna to the installation requirements.

12 Claims, 6 Drawing Sheets

| | |
|---|---|
| TYPE | = FAIRFIELD |
| MONITOR | = FARFIELD-5250 (1) |
| COMPONENT | = ABS |
| OUTPUT | = GAIN |
| FREQUENCY | = 5.25 |
| RAD. EFFIC. | = 0.9490 |
| TOT. EFFIC. | = 0.9486 |
| GAIN | = 6.691 dB |

| | |
|---|---|
| TYPE | = FAIRFIELD |
| MONITOR | = FARFIELD 5250 (1) |
| COMPONENT | = ABS |
| OUTPUT | = GAIN |
| FREQUENCY | = 5.25 |
| RAD. EFFIC. | = 0.8161 |
| TOT. EFFIC. | = 0.7931 |
| GAIN | = 7.812 dB |

DIVERSITY ANTENNA FOR UNII ACCESS POINT

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A "MICROFICHE APPENDIX"

Not applicable.

BACKGROUND OF THE INVENTION (1) Field of the Invention

This invention relates to wireless communications systems and more specifically to a diversity antenna for a UNII band access point.

(2) Description of the Related Art Including Information Disclosed Under 37 CFR 1.97 and 37 CFR 1.98

The Federal Communications Commission's ("FCC") promulgated rules for the Unlicensed National Information Infrastructure ("UNII") bands, 5.15–5.35 GHz and 5725 MHz to 5825 MHz. There are three UNII bands, each are 100 MHz bands. Of interest in the present application are the UNII-1 band, 5150–5250 MHz and the UNII-2 band, 5250–5350 MHz. The UNII-1 band is reserved for indoor wireless use. The UNII-2 band is designed for indoor or outdoor wireless LANs and allows for a higher powered, customizable antenna. By designing for the UNII-1 rules, the same system may be used on either UNII-1 or UNII-2. However, the FCC UNII rules require captured antennas for all products that operate in the UNII-1 band. Effectively, this rule does not allow a user to change antennas in the field.

Access Points (AP's) benefit from a variety of antennas that may be chosen or spatially oriented to suit the installation. Most applications can be installed with either a dipole antenna for an omni-directional coverage pattern or an external patch antenna for a directional coverage pattern. AP's and antennas may be mounted in a variety of environments. They may, for example, be mounted vertically on a wall, horizontally on a shelf, or hung from a ceiling.

Therefore, the need exists for an antenna system for UNII Access Points that conforms to the FCC UNII rules, offers the most flexibility in matching the characteristic of the antenna to the installation requirement, and has the benefits of a diversity antenna.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of instrumentalities and combinations particularly pointed out in the appended claims.

BRIEF SUMMARY OF THE INVENTION

In view of the aforementioned needs, the invention contemplates a combination of a near omni-directional antenna (almost omni-directional in the H-plane), and an internal, configurable low gain patch array that are all built into the access point in accordance with the FCC requirements. The antenna system will be rotatable so that the correct antenna orientation can be achieved to allow for more optimal coverage. When deploying the near-omni antennas, the antenna system will be rotated to the vertical and when deploying the patches, the system will be rotated to the horizontal. The present invention essentially provides the flexibility to meet the needs of the majority of access point installations encountered. The higher frequency of the UNII bands, 5 GHz, makes smaller geometry antennas possible within the product envelope.

The near omni-directional antenna (near-omni antenna) will be constructed on the same printed circuit board (PCB) as the patch array. These antennas have a (roughly) 180 degree 3-dB beamwidth and only about 10 dB maximum side lobe suppression, mostly in the direction of the other near omni-directional antenna.

The directional antenna comprises a typical TM10 mode rectangular patch antenna, probably realized with a stacked parasitic element to meet bandwidth requirements. Size and other physical dimensions determine the characteristics of the TM10 mode stacked patch antenna array.

A means for selecting the antenna type (either omni directional or directional) may be provided by either a configuration utility at installation or a small mechanical detect switch could be utilized to sense the orientation of the antenna system. If the AP is mounted on the ceiling or on a bookshelf (or any horizontal mounting), the near omni-directional antenna should be used and the installer will rotate the antenna system to the upright position. The mechanical detect switch will open causing the near-omnis to be deployed. If the AP is mounted on a wall, the installer will rotate the antenna system to the horizontal position causing the detect switch to close, thus deploying the patch antennas.

The present invention enables a single product to give a UNII 1–2 access point nearly all the required antenna flexibility of enterprise 2.4 GHz access points. The present invention provides adequate diversity for 5 GHz. OFDM systems are inherently robust against multipath conditions and the packet-by-packet diversity algorithms controlled by the MAC are applicable. The MAC diversity algorithm naturally converges to the strongest antenna as the default whether it is the near omni-directional antenna or the directional patch antenna, under normal use. The present invention would provide a huge degree of application flexibility at a very lost cost, since all the antennas are constructed on a single RF circuit board.

Among those benefits and improvements that have been disclosed, other objects and advantages of this invention will become apparent from the following description taken in conjunction with the accompanying drawings. The drawings constitute a part of this specification and include exemplary embodiments of the present invention and illustrate various objects and features thereof.

BRIEF DESCRIPTION OF THE SEVERAL VIEWS OF THE DRAWING

The drawings illustrate the best mode presently contemplated of carrying out the invention.

In the drawings.

DETAILED DESCRIPTION OF INVENTION

Figure 1:
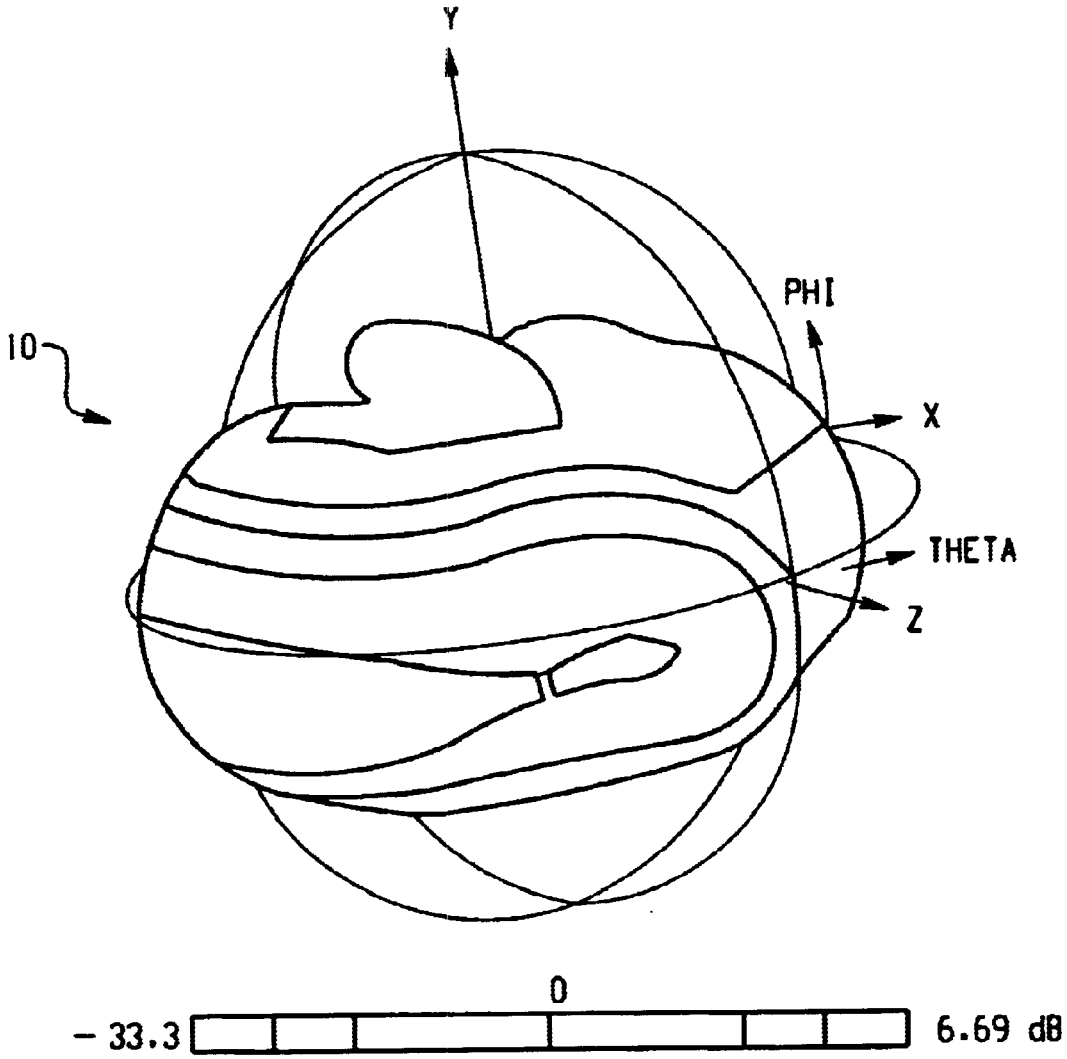
FIG. 1 is an isometric view of a typical near omni-directional radiation pattern.

The present invention utilizes the combination of captured near omni-directional antennas and internal patch antennas that are built into a UNII access point in accordance with FCC requirements. This combination provides the flexibility to meet the needs of the majority of installations for an access point. Smaller geometry antennas are possible at 5 GHz.

In the preferred embodiment, the near omni-directional antennas are an array of elements that are simple structures constructed on an RF circuit board, providing approximately 5-dBi gain. The entire antenna system can be rotated so that the near omni-directional antennas can be perpendicular to the ground, even when the access point is mounted in a non-perpendicular orientation, as is well known in the art and utilized in common dipole designs. The directional antenna is a TM10 mode patch antenna design that provides a conventional hemispherical pattern suitable for vertically mounted access points. The antenna system is rotated to the horizontal position when deploying the patch antennas. The choice of antenna type is made with a detect switch in the antenna system housing that senses whether the antenna system is rotated vertically or horizontally.

In an alternate embodiment, the antennas previously discussed are used. However, the installer chooses the antenna type to be used with the setup utility of the access point, and a control line from the radio MAC processor switches the antenna type. For example, if the installer wants a more hemispherical coverage pattern, he rotates the antenna system to the horizontal position, and selects "patch antenna" (or something similar) with the access point's setup utility. The MAC provides the control signal to do the switching.

The antenna type (either omni-directional or directional) is selected (in practice) at the time of installation and it depends on the type of coverage pattern desired. The selection should be made based on how the access point is mounted. If the AP is mounted horizontally (for example, on the ceiling or on a shelf), then the near omni-directional antenna should be deployed. If the AP is mounted on a wall, the patch antenna should be used. This selectable antenna feature allows one single AP to be used in most mounting scenarios, even though all the antennas are integral to the AP itself.

Once the selection of antenna type has been made at the time of installation, the MAC controls the diversity operation of the AP. That is, the MAC will determine whether the left antenna (of a given type) or the right antenna (of the same type) yields the best performance.

The present invention enables a single product to provide a 5 GHz UNII access point with the flexibility to select antenna functionality similar to 2.4 GHz access points and yet still allow for a low cost solution. Both the near omni-directional antennas and the patch antennas are constructed on the same printed circuit board that is integral to the access point enclosure to satisfy the FCC regulations. The near omni antennas (along with diversity) provide a traditional circular coverage pattern. The TM 10 mode patch antenna provides the traditional hemispherical pattern, suitable for corridor or narrow room coverage when the access point is mounted on a wall. This access point antenna system provides a large degree of application flexibility at a very low cost.

Referring to FIG. 1, there is shown a radiation pattern for the typical near omni-directional antenna. For the purposes of FIG. 1 it would be assumed the antenna is aligned with the Z-axis. The radiation from the antenna propagates primarily in the X-Y axis, normal to the Z-axis. The Z-axis coverage of this antenna is very small, and for practical purposes non-existent. By utilizing a rotatable antenna system that is similar to those used for 2.4 GHz systems, the near omni antenna can be deployed in such a manner that it would always be in the vertical position regardless of the orientation of the access point.

Figure 2:
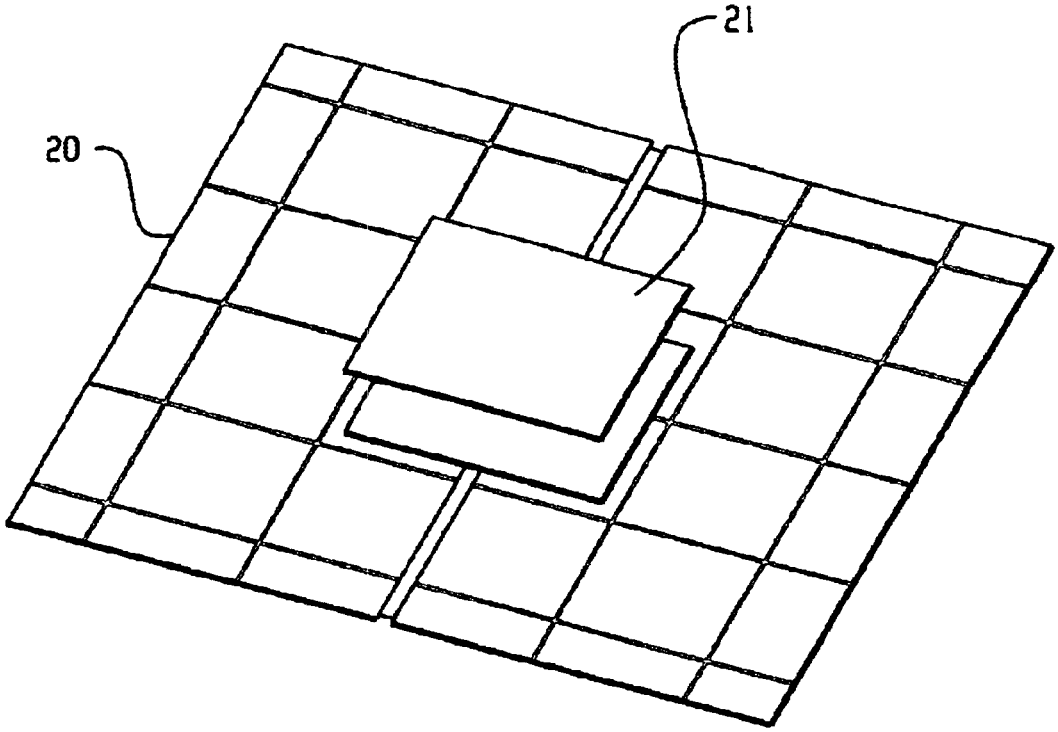
FIG. 2 is an isometric view of the basic geometry of a stacked patch antenna.
Figure 3:
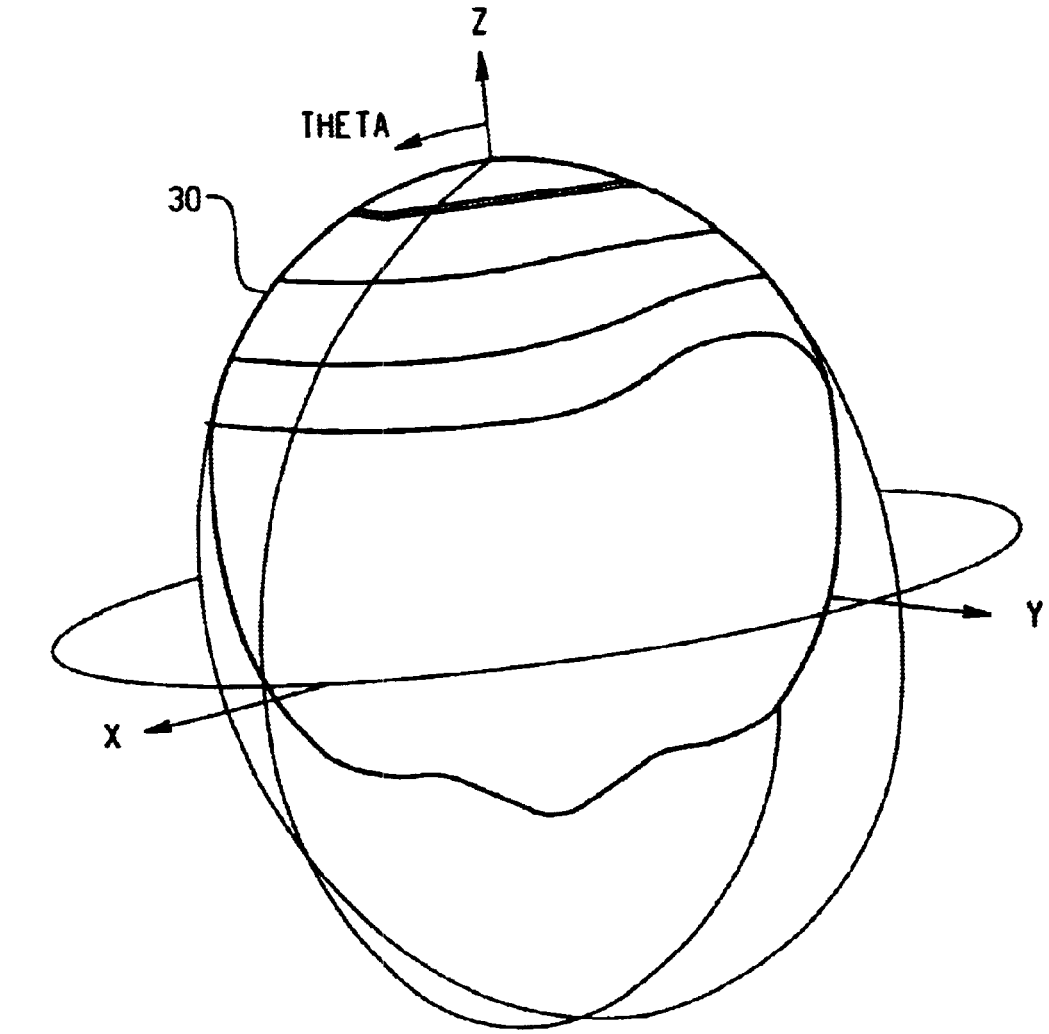
FIG. 3 is an isometric view of a typical three-dimensional radiation pattern for a TM10 mode stacked patch antenna.
Figure 3:
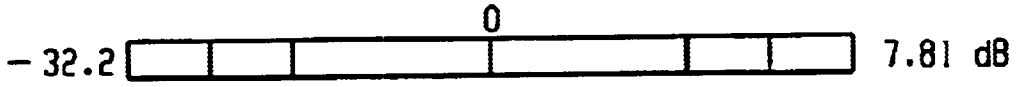

FIG. 2 shows the basic geometry a circular TM10 mode patch antenna, generally designated 20. The radiator 21 of the typical TM10 antenna 20 for use in a UNII access point would be approximately 17 mm×17 mm and have parasitic element deployed at a height of roughly 4 mm above the circuit board depending on bandwidth requirements. FIG. 3 shows the radiation pattern 30 from a TM10 mode patch as described in FIG. 2. The typical pattern of the TM10 mode patch antenna is hemispherical with E-plane 3-dB beamwidth of around 65 degrees and an H-plane 3-dB beamwidth of around 60 degrees in free space.

Figure 4:
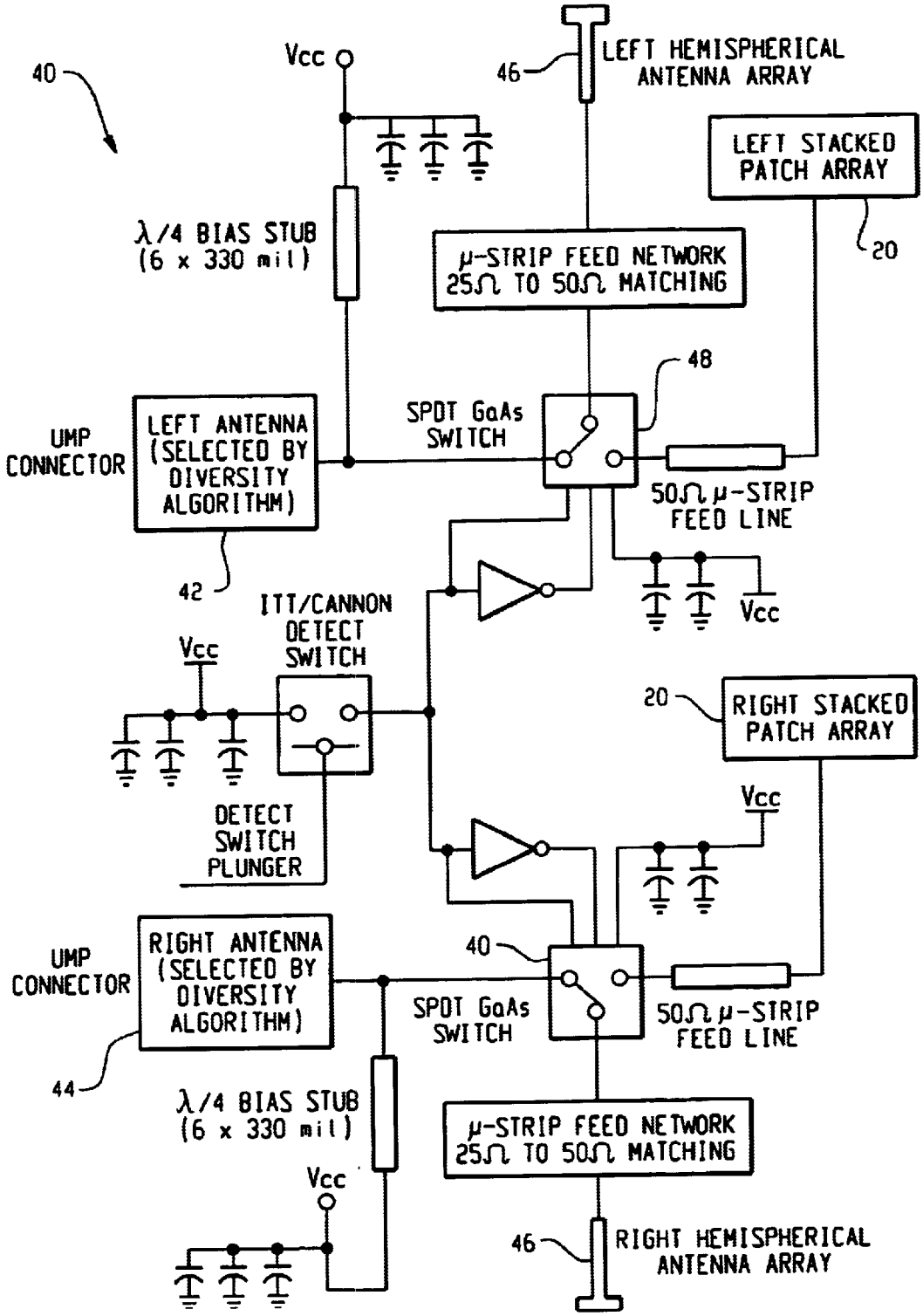
FIG. 4 is a block diagram of the preferred embodiment of the present invention.
Figure 6:
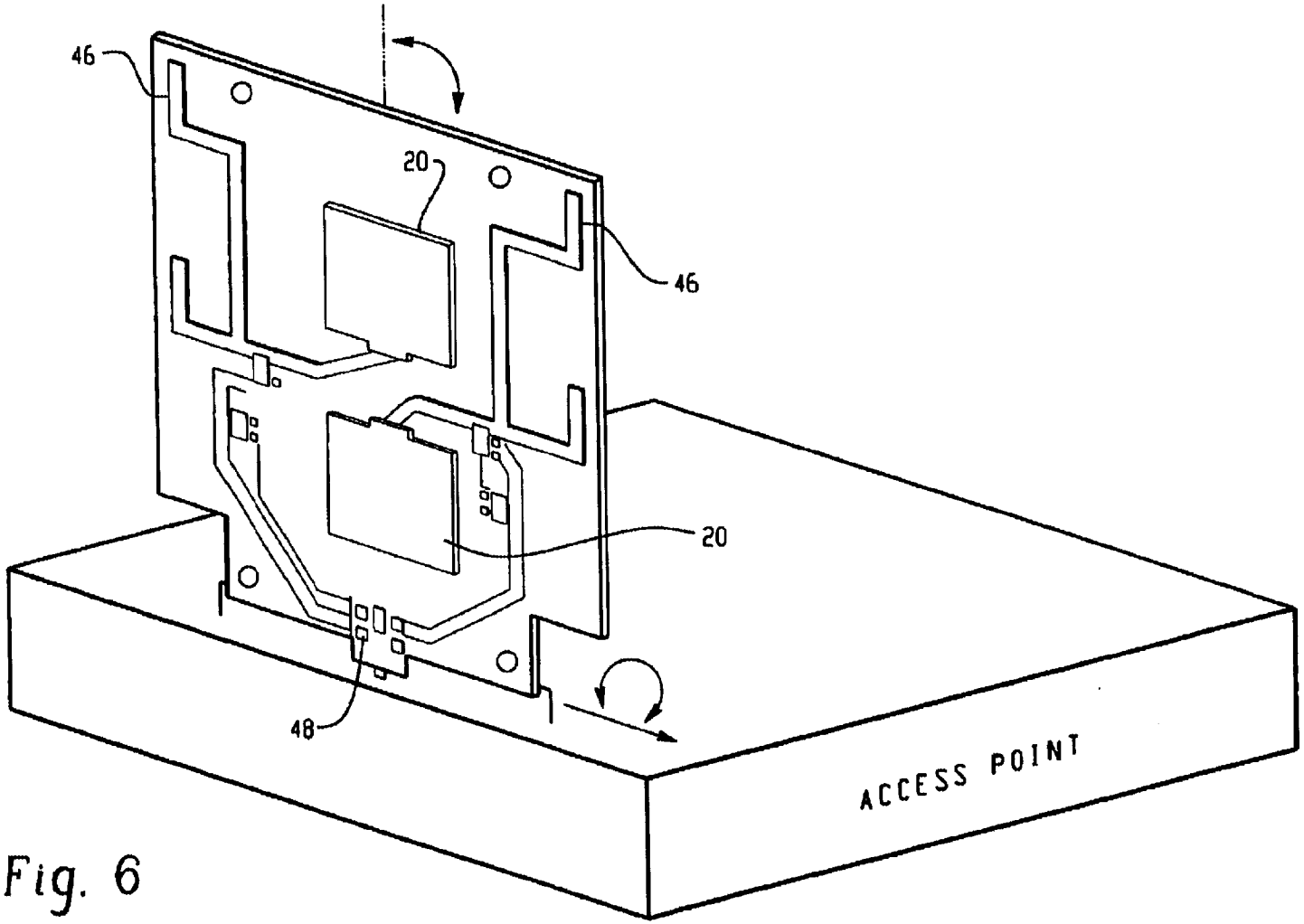
FIG. 6 is a view that shows the rotation of the present antenna with respect to an access point

The antenna type to be used is selected by a detect switch on the antenna system printed circuit board switch or by a configuration utility at installation time. FIG. 4 is a block diagram 40 of the preferred embodiment of the configurable antenna system showing the near omni-directional antennas and patch antennas in pairs, as is common in diversity systems. Both antenna ports, left antenna 42 and right antenna 44, have a vertical near omni-directional antenna 46, and a rectangular TM10 mode patch antenna 20 accessible to them. The detect switch 48 controls the antenna type selection. Typically a single-pole single-throw switch may be used for the detect switch 48, however as those skilled in the art can readily appreciate a number of switches are available to perform the equivalent function. As is shown in FIG. 6, if the antenna system is rotated to the vertical (perpendicular to the access point housing or parallel to but pointed away from the housing, the switch 48 opens and the near-omni directional antennas 46 are deployed automatically. If the antenna system is rotated to the horizontal (parallel to and on top of the access point housing), the detect switch 48 is closed and the patch antennas 20 are deployed automatically. This operation is done when the access point is configured and installed, but can be changed if the access point is moved or otherwise re-installed.

Figure 5:
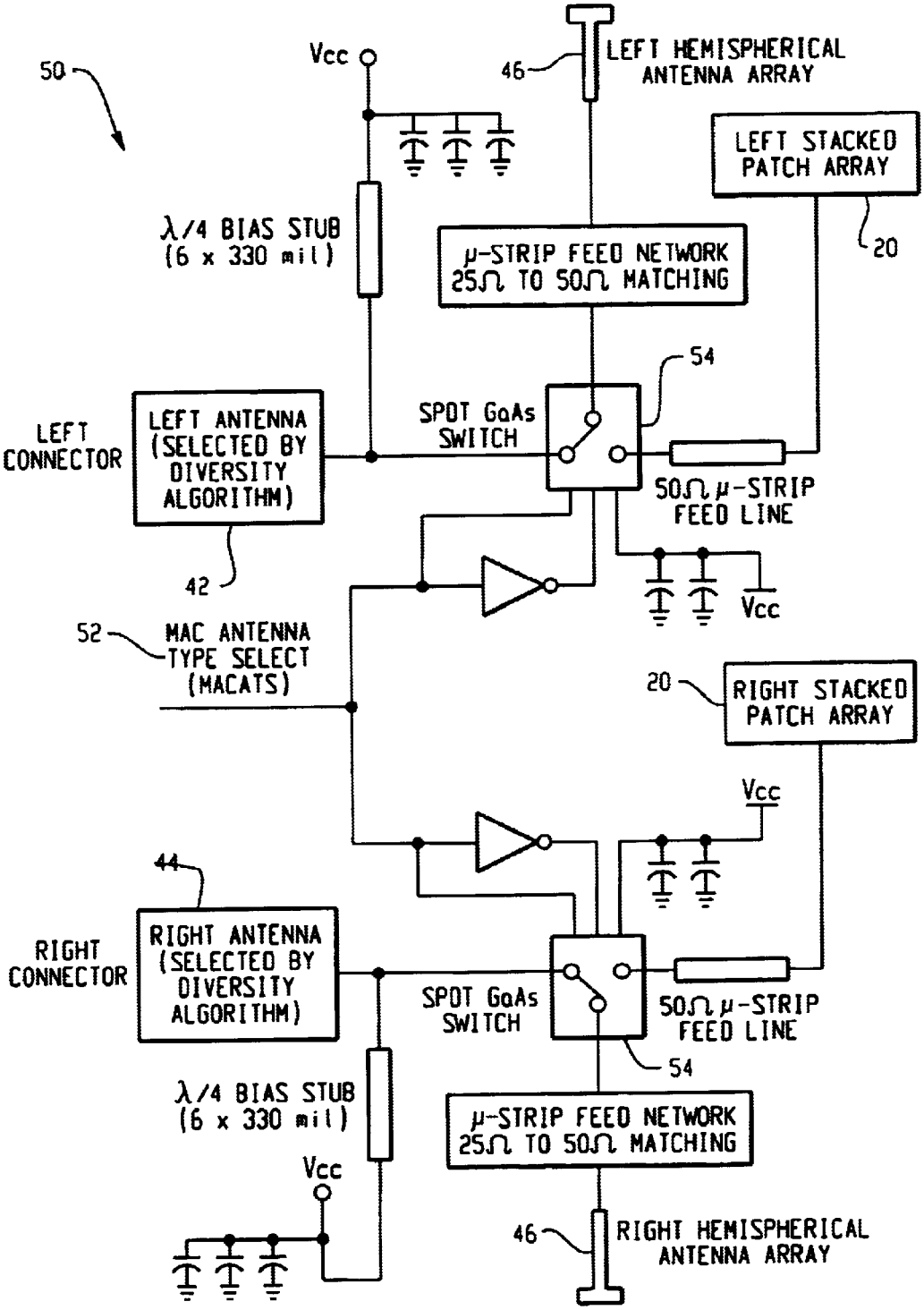
FIG. 5 is a block diagram of an alternate embodiment of the present invention.

In an alternate embodiment, shown in FIG. 5 which shows a block diagram of the embodiment and generally designated 50, a medium access controller antenna type select signal (MAC ATS signal) 52 is used to select the antenna type. The installer determines the type of antenna coverage required, rotates the antenna system to the desired position (vertical or horizontal) and then sets the antenna type using setup utility of the access point. The MAC controller then sets switches 54 based on the antenna type selected at installation. Normally, switches 54 would be semiconductor switches. The same antenna types are used as in the preferred embodiment, but the method of selection is different.

In either embodiment either the access point or a user in the field could change the antenna type without being able to change antennas external to the AP itself.

Once the selection of antenna type has been made at the time of installation, the MAC 52 will dynamically select either the left or the right antenna, based on system performance. OFDM systems are inherently robust against multipath conditions and packet-by-packet (or other) diversity algorithms are controlled by the MAC processor entirely on the radio board.

There are no diversity selection provisions required on this Configurable Antenna System board. Regardless of diversity algorithm, the MAC (on the radio) will find the best quality signal to use on either the right or left antenna.

While the invention has been described in terms of a preferred embodiment and an alternate embodiment, those skilled in the art can readily appreciate that the present invention is very flexible. For example, the patch antennas may be mounted on a single RF circuit board or on a plurality of RF circuit boards. The near omni-directional antennas 46 could be external, captured antennas that are rotatably mounted so that they can always be positioned in an appropriate manner. Besides access points, the present invention may also be utilized in other fixed environments such as repeaters, or for mobile units being utilized as repeaters.

Although the invention has been shown and described with respect to a certain preferred embodiment, it is obvious that equivalent alterations and modifications will occur to others skilled in the art upon the reading and understanding of this specification. The present invention includes all such equivalent alterations and modifications and is limited only by the scope of the following claims.

What is claimed is:

1. A diversity antenna system, comprising:

a diversity pair of near omni-directional antennas;

a diversity pair of internal patch antennas; and, configuration means for selecting antenna type, the antenna type being one of the group consisting of the diversity pair of near omni-directional antennas and the diversity pair of internal patch antennas.

2. The diversity antenna system of claim 1, wherein the diversity antenna system is rotatably mounted.

3. The diversity antenna system of claim 1, the internal patch antennas comprising a TM10 mode patch antenna.

4. The diversity antenna system of claim 1 wherein the configuration means is one of the group consisting of:

a mechanical detect switch operable to determine the antenna type to be deployed, and a microprocessor having computer readable instructions stored on a computer readable medium, the computer readable instructions comprising, computer readable instructions for receiving input from a user;

computer readable instructions responsive to said input for selecting the type of antenna based on said input.

5. The diversity antenna system of claim 1, the configuration means comprising a mechanical detect switch, said detect switch sensing the orientation of the diversity antenna system and selecting the antenna type based on said orientation.

6. The diversity antenna system of claim 1 wherein the diversity pair of near omni-directional antennas and the diversity pair of internal patch antennas are constructed on the same printed circuit board.

7. The diversity antenna system of claim 1 wherein the diversity antenna system is a component of a wireless access point.

8. A diversity antenna system for a UNII access point, comprising:

an internal, captured, rotatably mounted near omni-directional antenna;

a circuit board mounted inside the access point, the circuit board comprising:

a near omni-directional antenna, a TM10 mode patch antenna; and a configuration means for selecting the antenna type, the antenna type being one of the group of internal, captured, rotatably mounted near omni-directional antenna, the near omni-directional antenna and the TM10 patch mode antenna.

9. The diversity antenna system of claim 8 wherein the configuration means comprises a mechanical detect switch.

10. The diversity antenna system of claim 8, wherein the configuration means comprises:

a semiconductor switch; and a microprocessor having computer readable instructions stored on a computer readable medium, the computer readable instructions comprising, computer readable instructions for receiving input from a user;

computer readable instructions responsive to said input for selecting the type of antenna based on said input by controlling the semiconductor switch.

11. The antenna system of claim 8, wherein the access point is selected from the group consisting of a UNII-1 and a UNII-2 access point.

12. A diversity antenna system for a UNII access point, comprising:

an internal, captured, rotatably mounted near omni-directional antenna;

a circuit board mounted inside the access point, the circuit board comprising:

a near omni-directional antenna, a TM10 mode patch antenna, a semiconductor switch for switching to one of the internal, captured, rotatably mounted near omni-directional antenna, the near omni-directional antenna, and the TM10 mode patch antenna;

connection means adapted to connect the internal, captured, rotatably mounted near omni-directional antenna, the near omni-directional antenna, and the TM10 mode patch antenna to the semiconductor switch; and a configuration means adapted to cause the semiconductor to switch for selecting the antenna type, the antenna type being one of the group of the internal, captured, rotatably mounted near omni-directional antenna, the near omni-directional antenna and the TM10 patch mode antenna.

* * * * *